United States Patent [19]

Eisenmann et al.

[11] Patent Number: 4,905,896

[45] Date of Patent: Mar. 6, 1990

[54] RAILROAD ROADWAY FOR HIGH SPEED RAIL-MOUNTED VEHICLES

[75] Inventors: Josef Eisenmann, Munich; Dieter Hilliges, Neuried; Günther Leykauf; Helmut Lieske, both of Munich; Herbert Schambeck, Frieding; Werner Sievers, Baldham, all of Fed. Rep. of Germany

[73] Assignee: Dyckerhoff & Widmann Aktiengesellschaft, Munich, Fed. Rep. of Germany

[21] Appl. No.: 262,421

[22] Filed: Oct. 25, 1988

[30] Foreign Application Priority Data

Oct. 31, 1987 [DE] Fed. Rep. of Germany ..... 37369431

[51] Int. Cl.[4] ..... E01B 1/00

[52] U.S. Cl. ..... 238/2; 404/31; 404/41; 404/70

[58] Field of Search ..... 238/2, 5, 3, 7, 8, 9, 238/106, 392; 104/2, 3, 16, 17.1, 17.2; 404/27, 28, 29, 30, 31, 34, 37, 45, 41, 50, 53, 70, 100, 134

[56] References Cited

U.S. PATENT DOCUMENTS

| | | | |
|---|---|---|---|
| 763,008 | 6/1904 | MacKenzie | 238/7 |
| 1,241,405 | 9/1917 | Leach | 404/50 |
| 1,916,620 | 7/1933 | Johnson | 404/41 |
| 2,367,146 | 1/1945 | Siebs | 238/7 |
| 2,716,373 | 8/1955 | Scrivner et al. | 404/50 |
| 3,141,614 | 7/1964 | Alsenz et al. | 238/8 |
| 3,640,191 | 2/1972 | Hendrich | 404/41 |
| 3,851,989 | 12/1974 | Peach | 404/50 |
| 4,232,822 | 11/1980 | Hahn et al. | 238/2 |
| 4,232,823 | 11/1980 | Eggermann | 238/2 |
| 4,500,037 | 2/1985 | Braitsch et al. | 238/2 |
| 4,703,890 | 11/1987 | Tognoli et al. | 238/7 |

FOREIGN PATENT DOCUMENTS

| | | | |
|---|---|---|---|
| 839363 | 4/1952 | Fed. Rep. of Germany | 238/106 |
| 2365505 | 5/1975 | Fed. Rep. of Germany | 238/7 |
| 2830138 | 1/1980 | Fed. Rep. of Germany | 238/7 |
| 3532766 | 3/1987 | Fed. Rep. of Germany | 238/2 |
| 2144 | 1/1912 | United Kingdom | 238/3 |
| 4196 | 3/1915 | United Kingdom | 404/50 |
| 623729 | 5/1949 | United Kingdom | 404/50 |

OTHER PUBLICATIONS

Railroad Gazette, Mar. 20, 1908, vol. 45, p. 1384.

Einsatz Der Festen Fahrbahn Auf Den Neubaustrecken Der Deutschen Bundesbahn*) by Dieter Hilliges, pp. 347–353, vol. 7, 1987.

*Primary Examiner*—Andres Kashnikow

*Assistant Examiner*—Mark T. Le

*Attorney, Agent, or Firm*—Toren, McGeady & Associates

[57] ABSTRACT

A railroad railway for rail-mounted vehicles capable of high speed travel includes a track grating formed of rails and ties with the ties partially embedded in a poured-in-place steel reinforced concrete slab. The concrete slab is mounted on a continuous concrete substructure with a separating layer arranged between the slab and substructure. A single layer of steel reinforcement is located in the concrete slab spaced below the ties. The slab is dimensioned so that it serves only for plate-like stiffening of the track grating without any appreciable inherent bending resistance. The slab is secured against longitudinal and transverse displacement of the substructure, while the substructure is dimensioned to absorb bending moments developed in the longitudinal direction of the rails. The concrete slab is divided in the longitudinal direction by transversely extending expansion joints whereby sections of the slab can be replaced if damage occurs. There is sufficient space between adjacent ties above the concrete slab to add sound absorbing material.

14 Claims, 2 Drawing Sheets

Fig. 5
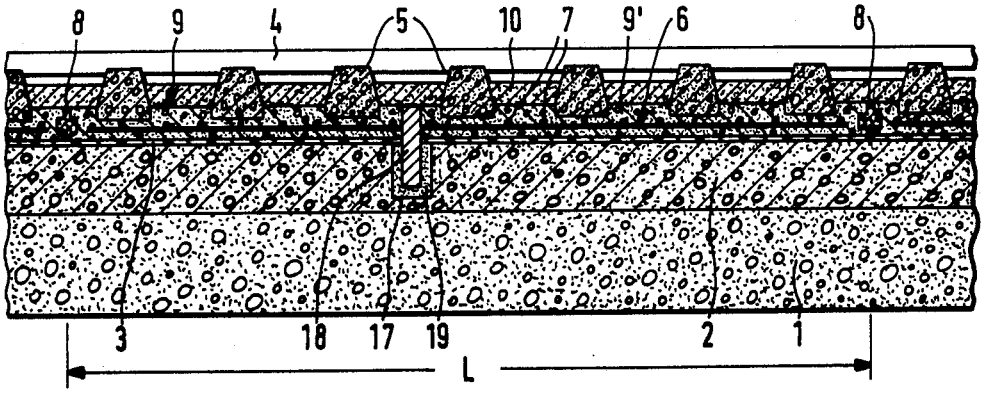
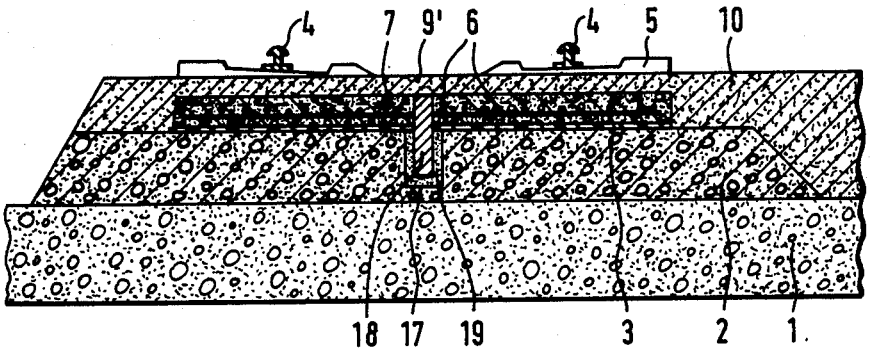
Fig. 6

RAILROAD ROADWAY FOR HIGH SPEED RAIL-MOUNTED VEHICLES

BACKGROUND OF THE INVENTION

The present invention is directed to a railroad roadway, particularly for rail-mounted vehicles operating at high speeds, and includes a track grating made up of rails and concrete ties with the ties partially embedded in a steel reinforced concrete slab. The concrete slab is reinforced in the longitudinal and transverse directions of the rails and the slab is poured in place on a continuous concrete substructure or base deposited on a subgrade with a separating layer between the concrete slab and the substructure.

In railroad roadways, the usual construction of a track still utilizes transverse ties supported on a ballast bed. This form of track construction, however, involves steadily increasing costs for maintenance, primarily for cleaning and compressing the ballast bed, especially where trains travel at very high speeds and have high axle loads. In contrast, the maintenance costs for rails, rail fastenings, and ties, particularly prestressed concrete ties, is small.

As an alternative to the use of ballast in a railroad roadway, it has been known to place the rails on continuous longitudinal girders, on gratings made up of longitudinal and transverse girders, or on continuous steel reinforced concrete slabs for transmitting loads into the subgrade as uniformly as possible. In poured-in-place slabs o gratings using steel reinforced concrete, the exact positioning of the rail fastenings poses difficulties. In addition, cracks resulting from deformation due to temperature cannot be avoided in continuous slabs and, in addition, the removal of surface water and cleaning of the slabs causes problems. Furthermore, the generation of noise is disproportionately greater in continuous slabs than in a railroad roadway employing ballast.

Another alternative to a railroad roadway using ballast is a known type of construction involving a steel reinforced concrete slab poured in place with steel reinforced concrete ties incorporated as track holding elements, note DE-C "Der Eisenbahningenieur" (Railroad Engineer), 38, 1987, Volume 7, pp. 347 to 353. By embedding prestressed concrete ties in the steel reinforced concrete slab, the rail fastenings in the ties are not effected by cracks in the slabs, as is the case when the rails are fastened directly to the steel reinforced concrete slabs. Instead, the unavoidable formation of free cracks in the steel reinforced concrete slab occurs in the form of finely distributed and harmless cracks along the flanks or sides of the ties. To construct such a railroad roadway, a track grating made up of ties and rails is first prepared for a predetermined length and is aligned and adjusted on a subgrade. The concrete for the slab is then poured and compacted with the concrete extending for a large part of the height of the ties and thus forming a bed for the ties. Accordingly, such a railroad roadway construction has good adaptability to different curves and different elevations of the rails in curved tracks. Its design differs depending on its application on a subgrade or in a tunnel.

In the construction of this load-bearing system on a subgrade, as is customary on open rail lines, a gravel base, approximately 20 cm thick and hydraulically set, forms a substructure placed on a frost-protection layer consisting of gravel. The supporting slab, positioned on the substructure with an intermediate layer of asphalt paint acting as a separating layer in the event a height adjustment is required, is constructed of poured-in-place concrete with a height dimension of 14 cm under the ties and an additional 12.5 cm height in the spaces between the ties. As a result, the slab has an over-all height or thickness of 26.5 cm The part of the supporting slab located below the ties includes a layer of crossing reinforcement. The concrete in the spaces between the sleepers is connected with the lower part of the slab by means of stirrups, and longitudinal reinforcement and transverse reinforcement in the form of reinforcing bars extends through holes in the ties. Such a supporting slab is poured in a number of layers and has a pronounced load distributing effect whereby the bending resistance of the slab has a pronounced significance in relation to the substructure.

In similar supporting systems for railways in tunnels, the tunnel floor constructed of steel reinforced concrete is available as an effective bearing foundation, so that the height of the poured-in-place concrete layer under the tie can be reduced to a minimum amount of 5 cm required for pouring the concrete. In this arrangement, only longitudinally reinforcement is used consisting of reinforcing bars extending through holes in the ties. Further, in such an arrangement, it has been suggested to position sound absorbing material on and next to the fixed roadway for absorbing airborne noise. Due to the considerable thickness of the supporting slab, especially in the region between the ties, the layer of such material can only be very thin and, as a result, it is not very effective.

SUMMARY OF THE INVENTION

Therefore, the primary object of the present invention is to provide a railroad roadway which is easy to construct, primarily by avoiding the use of holes in the ties for guiding longitudinally extending reinforcement, and by providing sufficient space for the installation of sound absorbing material on the surface of the slab. Such a construction retains to a considerable extent the advantageous characteristics of this general type of railroad roadway construction, that is, insuring track gage and rail inclination in all assembly and operating states by using concrete ties, particularly prestressed concrete ties, and locating the steel reinforcing concrete slab, interconnecting the ties, on the substructure or base in an all-over and frost-resistant manner by using poured-in-place concrete. Further, it should be possible to replace or repair the railroad roadway with the least possible disturbance of railroad operation.

In accordance with the present invention, the steel reinforced concrete slab has the reinforcement located in a single continuous layer in a plane below the ties and with a relatively small embedment of the ties in the slab. Accordingly, the slab is dimensioned so that it serves only for the plate-like stiffening of the track grating in the horizontal direction without any significant inherent bending resistance. Further, it is supported on the concrete substructure with displacement resistance in the region of a separating layer between the slab and the substructure. Further, the concrete substructure is dimensioned so that it can absorb bending moments occurring in the longitudinal direction as a result of any load transferred through the rails.

Preferably, the steel reinforced concrete slab is divided in the longitudinal direction into individual sections by transversely extending expansion joints. Each of the individual sections is secured relative to the concrete substructure against displacement in the longitudinal and transverse directions. In addition, the expansion joints are constructed in such a way that transverse forces can be transmitted in the vertical and lateral directions.

To secure the individual sections of the steel reinforced concrete slab against displacement, the upper surface of the concrete substructure can be shaped in at least one location along its length, that is, by providing recesses or projections, and by providing corresponding projections or recesses in the undersurface of the poured-in-place sections of the concrete slab.

Alternatively, a spike-like member can be provided for each section of the steel reinforced concrete slab, preferably in the center of gravity of the deformation of the section, with the spike-like member engaging in a corresponding recess in the concrete substructure. The recess can be filled with a material affording subsequent removal of the spike-like member.

The concrete ties can be provided with stirrups forming reinforcement loops projecting downwardly from the underside of the ties for effecting an anchorage in the reinforced concrete slab. Preferably, the loops have parts extending substantially parallel to the underside of the ties.

Finally, sound absorbing material can be placed on the upper surface of the reinforced concrete slab, preferably in the spaces between adjacent ties.

The basic concept of the invention is that the steel reinforced concrete slab, poured in place, does not function as a support with noticeable bending resistance, rather it affords only a plate-like stiffening of the track grating in the horizontal direction. Accordingly, the substructure, in the form of a hydraulically set gravel base, is formed as a concrete substructure and functions to accommodate longitudinal bending moments and is dimensioned in accordance with such moments and may include a corresponding reinforcement. In accordance with the invention, the concrete slab can be provided with a thickness of 16 cm with a depth of 10 cm below the ties and such over-all depth or thickness is sufficient for a poured-in-place reinforced concrete slab. In the prior art, the thickness of the concrete base has been approximately 30 to 40 cm.

Based on the dimensions of the poured-in-place concrete slab, the longitudinal reinforcement can be located exclusively below the ties in a single layer. As a result, the provision of holes in the ties for longitudinally extending reinforcing bars is avoided. Accordingly, the production of the ties and of the poured-in-place concrete slab is facilitated. Since a comparatively shallow embedment in the poured-in-place concrete slab is sufficient for fixing the track grating made up of the rails and ties, a sufficient depth remains in the spaces between adjacent ties for introducing sound absorbing material, such as cellular-expanded concrete or concrete in which the course particles of the aggregate are cemented only by cement paste, so that cavities or spaces remain which serve for the absorption of airborne sound. Since the poured-in-place concrete of the present invention does not need to absorb bending moments, it can be divided into individual longitudinally extending sections by transversely extending expansion joints. If damage occurs to the railroad roadway, particularly in the event of a derailment, it is possible to remove individual sections more easily and quickly and to replace such sections. With the division of the slab into individual sections, it is also possible to raise the sections if settling occurs. Such sections can be underfilled with a hardenable material for fixing them in an adjusted position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 5 is a longitudinal sectional view of another embodiment of a railroad roadway incorporating the present invention; and FIG. 6 is a transverse cross-sectional view of the railroad roadway displayed in FIG. 5.

DETAILED DESCRIPTION OF THE INVENTION

To construct a railroad roadway, in accordance with the present invention, a frost protection layer 1 of conventional construction and thickness is applied to a prepared subgrade. A concrete substructure 2, possibly including reinforcement, is placed on the frost protection layer 1. The concrete substructure 2 has a thickness or depth of approximately 30 to 40 cm. A separating layer 3 is placed over the upper surface of the concrete substructure 2, such as in the form of a foil.

Figure 1:
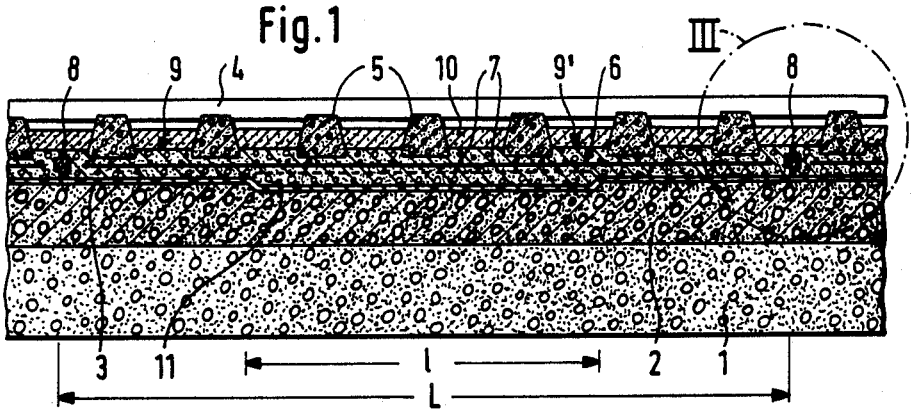
FIG. 1 is a partial longitudinal section of a railroad roadway in accordance with the present invention.

A track grating, assembled beforehand from longitudinally extending rails 4 and prestressed concrete ties 5, extending transversely of the rails, is supported over the substructure 2 after placement of the longitudinal reinforcing bars 6 and the transverse reinforcing bars 7. The track grating is aligned and adjusted according to height by means of spindles, and is held in the required position relative to the separating layer 3. As a result, the bottoms of the concrete ties 5, are spaced upwardly from the separating layer 3. At this point, transverse expansion joints 8, for transmitting vertical and lateral forces in the region of the joints, are placed in position. Concrete is then poured forming a poured-in-place concrete slab 9 and the concrete slab is compacted. The height of the concrete slab 9 above the separating layer 3 to the underside of the ties 5 is approximately 10 cm and the height of the concrete slab, above the underside of the ties, is approximately 6 cm so that the over-all depth or height of the slab is approximately 10 cm between the separating layer 3 and the underside of the ties 5. Between the ties, the height of the slab is approximately 16 cm. As a result, a height of approximately 10 cm remain between adjacent ties 5 above the top of the slab 9 for receiving a layer 10 of airborne sound absorbing material. As can be seen in FIG. 1, the poured-in-place concrete slab 9 is divided by the transverse joints 8 into a number of longitudinally extending sections 9'.

Figure 2:
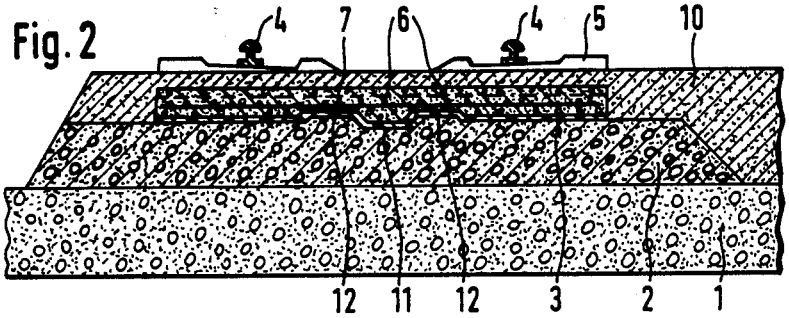
FIG. 2 is a transverse cross-sectional view through the railroad roadway shown in FIG. 1.

As illustrated in FIGS. 1 and 2, means are provided to prevent displacement between the individual sections 9' of the concrete slab 9 and the subjacent concrete substructure 2. Such means are located approximately in the center of each section 9'. Such means prevent each section 9', separated from the concrete substructure 2 by the separating layer 3, from displacement relative to the concrete substructure as a result of temperature changes or horizontal forces. In the embodiment displayed in FIG. 1, a recessed portion 11 extending in the longitudinal direction is formed in the concrete substructure 2 in the central region of the superposed section 9' of the concrete slab 9. As can be noted in FIG. 2, the recessed portion 11 is flanked on each of its longitudinally extending sides by a projecting portion 12 disposed parallel to the recessed portion. It can be seen in FIG. 1, that the recessed portion 11 and the projecting portions 12, extend along only a part 1 of the over-all length L of the concrete slab section 9'. The separating layer or foil 3 is shaped to correspond to these recessed and projecting portions. The lower surfaces of the concrete slab sections 9' corresponding to the recessed portion 11, and the projecting portions 12, are formed during the subsequent placement of the concrete for the poured-in-place concrete slab 9.

Figure 3:
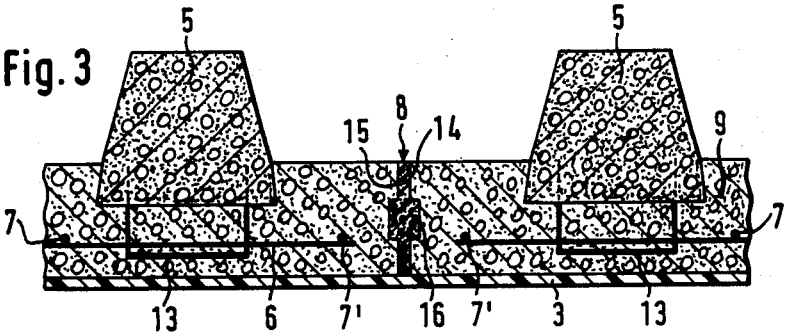
FIG. 3 is an enlarged cross-sectional view of the encircled area designated by III in FIG. 1, in the region of an expansion joint in the concrete slab.

As shown in the enlarged partial sectional view of FIG. 3, the concrete ties 5 are provided with stirrups forming reinforcement loops 13 projecting downwardly from the underside of the ties into the poured-in-place concrete slab 9 for effecting improved interengagement between the ties and the concrete slab. The reinforcement loops 13 each have a section extending parallel to and spaced downwardly from the underside of the ties, so that the ties 5 can stand upright during assembly without any additional supports.

Figure 4:
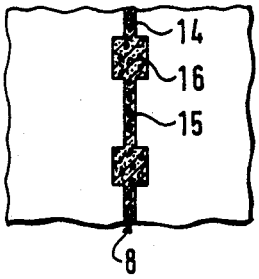
FIG. 4 is a partial plan view of a transverse expansion joint.

In FIG. 3, one embodiment of the form of the transverse expansion joints 8 is shown in cross-section and is illustrated in a partial plan view of the joint in FIG. 4. The expansion joint 8 is formed by a joint element 14 formed of a band-like section 15 provided with enlarged portions 16 at spaced intervals with the enlarged portions projecting outwardly from the opposite sides of the band-like section. The enlarged portions or sections 16 form surfaces extending perpendicularly to the band-like section, so that the transmission of vertical and lateral forces is possible by means of the joint element 14. Joint element 14 is formed of a shear-resistant and compression-resistant member, such as fiber concrete or the like.

To prevent any possible separation in the region of the poured-in-place concrete slab 9 between adjacent ties 5 on opposite sides of a transverse expansion joint 8, the transverse reinforcing bars 7' adjacent to the transverse joints 8 can be welded to the ends of the longitudinally extending reinforcing bars 6.

Another embodiment of a railroad roadway incorporating the present invention is displayed in FIG. 5 in longitudinal section and in FIG. 6 in transverse section similar to FIGS. 1 and 2. To fix a section 9' of the poured-in-place concrete slab 9, a recess 17 is provided in the concrete substructure 2 approximately in the center of gravity of the deformation of the section. A metallic spike-like member 18, securely connected to the section 9', extends into the recess 17. The dimensions of recess 17 and of the spike-like member 18 are such that a space remains between the walls of the recess and the spike-like member. This space is filled with a material, such as asphalt 19 for enabling a subsequent removal of the spike-like member 18 for replacement of a section 9' of the poured-in-place concrete slab 9, if necessary.

In another construction, in accordance with the present invention, it is possible to provide connections at the poured-in-place concrete slab 9, particularly in the form of connection reinforcements for erecting additional devices, such as signal masks, catenary supports, sound absorption walls, or the like, without separate foundations.

While a specific embodiment of the invention has been shown and described in detail to illustrate the application of the inventive principles, it will be understood that the invention may be embodied otherwise without departing from such principles.

We claim:

1. Railroad for rail-mounted vehicles capable of high speed travel comprising at rack grating including longitudinally extending rails and concrete ties extending transversely of and supporting said rails, a poured-in-place steel reinforced concrete slab supporting said track grating with said ties partially embedded in said slab, said slab includes longitudinal steel reinforcements extending in the longitudinal direction of said rails and transverse steel reinforcements extending in the direction of said ties, a continuous concrete substructure supporting said slab and arranged to be supported on a subgrade, and a separating layer located between said slab and said substructure, wherein the improvement comprises that said steel reinforcements are located in a single generally horizontal continuous layer in a plane located below said ties, said ties having a height dimension extending generally vertically with a relatively small portion of the height embedded within said slab, said slab comprises only a plate-like stiffener for said track grating lacking appreciable inherent bending resistance, means for affording displacement resistance in the region of said separating layer between said slab and said substructure, said substructure being dimensioned to absorb bending moments occurring in a longitudinally extending direction of the said rails as a result of a load directed on said rails, said concrete slab is divided in the longitudinal direction of said rails into individual sections with expansion joints extending transversely of said rails and located between adjacent said sections, said displacement resistance means located in each of said sections and in said substructure for preventing displacement of said sections relative to said substructure in the longitudinal and transverse directions of said rails, means in said expansion joints for transmitting forces in the vertical and lateral directions of said expansion joints, said ties have a lower surface facing toward said substructure, reinforcement loops secured within said ties and projecting from the lower surface thereof into said concrete slab for anchoring said ties in said slab, said concrete slab having a lower surface in contact with said substructure and an upper surface intermediate the lower surface and an upper surface of said ties, said concrete slab having an upward dimension between the lower surface thereof and the lower surface of said ties greater than the upward dimension of said concrete slab between the lower surface of said ties and the upper surface of said concrete slab.

2. Railroad roadway, as set forth in claim 1, wherein said means for displacement resistance comprises an upper surface of said substructure disposed in opposed relation to a lower surface of said concrete slab sections, at least one of recesses and projections located in each of said upper surface and said lower surface, said recesses and projections being arranged in interfitting relation for preventing displacement of said sections of said concrete slab relative to said substructure.

3. Railroad roadway, as set forth in claim 2, wherein said recesses and projections have sides extending in the longitudinal direction of said rails and sides extending in the transverse direction of said ties with said sides of said recesses and projections in said substructure and concrete slabs arranged in interfitting engagement.

4. Railroad roadway, as set forth in claim 3, wherein said separating layer deposited on the surface of said substructure facing toward said concrete slab and shaped to follow the at least one of said recesses and projections formed in the surface of said substructure.

5. Railroad roadway, as set forth in claim 1, wherein said means for displacement resistance comprises at least one spike-like member secured to each said section of said concrete slab with said spike-like member extending into a corresponding recess in said substructure.

6. Railroad roadway, as set forth in claim 5, wherein said at least one spike-like member is located in the center of gravity of the thermal deformation of said section of said concrete slab.

7. Railroad roadway, as set forth in claim 5, wherein means located within said recess for permitting removal of said spike-like member.

8. Railroad roadway, as set forth in claim 7, wherein said means for permitting removal of said spike-like member comprises asphalt.

9. Railroad roadway, as set forth in claim 1, wherein said reinforcement loops include a part spaced below and extending substantially parallel to the lower surface of said ties.

10. Railroad roadway, as set forth in claim 1, wherein a sound absorbing material is positioned on the upper surface of said concrete slab between said ties with said sound absorbing material extending upwardly from said concrete slab.

11. Railroad roadway, as set forth in claim 1, wherein said expansion joints are formed of a band-shaped material with space projection sections extending outwardly from opposite sides of said band-shaped material.

12. Railroad roadway, as set forth in claim 1, wherein said transverse steel reinforcement located adjacent said expansion joints being welded to ends of said longitudinal steel reinforcement adjacent said expansion joints.

13. Railroad roadway, as set forth in claim 1, wherein said concrete slab having a height extending perpendicularly to said substructure of 16 cm and a height between said substructure and the lower surface of said ties of 10 cm.

14. Railroad roadway as set forth in claim 13, wherein said concrete substructure has a height of approximately 30 to 40 cm.

* * * * *